US005117407A

United States Patent [19]

Vogel

[11] Patent Number: 5,117,407

[45] Date of Patent: May 26, 1992

[54] VENDING MACHINE WITH SYNTHESIZED DESCRIPTION MESSAGES

[76] Inventor: Peter S. Vogel, 28 Adeline St., Faulconbridge, NSW 2776, Australia

[21] Appl. No.: 439,378

[22] PCT Filed: Feb. 8, 1989

[86] PCT No.: PCT/AU89/00051

§ 371 Date: Oct. 25, 1989

§ 102(e) Date: Oct. 25, 1989

[87] PCT Pub. No.: WO89/07807

PCT Pub. Date: Aug. 24, 1989

[30] Foreign Application Priority Data

Feb. 11, 1988 [AU] Australia ..... PI6706

[51] Int. Cl.[5] ..... G07F 7/02; G08B 23/00

[52] U.S. Cl. ..... 369/30; 369/32; 360/12

[58] Field of Search ..... 360/12, 92, 15, 137; 369/32, 20, 30

[56] References Cited

U.S. PATENT DOCUMENTS

| | | | |
|---|---|---|---|
| 3,609,250 | 9/1971 | Morris | 369/32 |
| 4,142,216 | 2/1979 | Goss et al. | 360/72.1 |
| 4,359,631 | 11/1982 | Lockwood et al. | 360/12 |
| 4,445,147 | 4/1984 | Kessman et al. | 369/30 |
| 4,670,798 | 6/1987 | Campbell et al. | 369/19 X |
| 4,984,084 | 1/1991 | Buntsis | 360/12 |

OTHER PUBLICATIONS

CAM-Talker—Advertising Brochure—1985.

*Primary Examiner*—Robert L. Richardson

[57] ABSTRACT

A vending machine adapted to reproduce audio and video messages relating to the products being dispensed. The video portion of the message is produced by a video synthesizer which displays objects which are animated in response to the audio message. For example, a human-like face can be synthesised, the lips of which move in response to speech being replayed. The vending machine can also be a music juke-box.

9 Claims, 4 Drawing Sheets

VENDING MACHINE WITH SYNTHESIZED DESCRIPTION MESSAGES

TECHNICAL FIELD

The invention relates to means for dispensing merchandise and in particular improvements in the means for announcing to prospective consumers of a product descriptions of the merchandise on offer. The invention finds particular application to vending machines and jukeboxes.

BACKGROUND ART

A wide variety of vending machines are in use for diverse products, however the means of advertising the particular products from which the purchaser can select has hitherto been limited to static advertisements such as printed images and words fixed to the machine. Much reliance is placed on the public's knowledge of brand names as a basis for choice, and in the event that a potential purchaser is confronted with unfamiliar items, a sale can be lost. It is therefore desirable that the vending machine offer as much product information as possible. A variation of the vending machine, in which the merchandise on offer is music, is known as the jukebox, and in this case also it is desirable to offer information descriptive of the available musical selections in order to induce the purchaser to select unfamiliar titles.

The present invention is directed to providing dispensers including vending machines and jukeboxes which deliver to potential customers informative and interesting messages describing the merchandise on offer.

DISCLOSURE OF INVENTION

According to the present invention there is provided dispenser means comprising means for storing merchandise; means for dispensing merchandise; means for initiating delivery of merchandise; means for storing messages, said messages relating to said stored merchandise; means for initiating delivery of said messages; and means for delivering said messages.

In one advantageous embodiment of the invention the means for storing messages comprises audio message storage means, such as a tape or disc recording carrying messages describing different items of merchandise available.

In another advantageous embodiment of the invention the means for storing messages comprises video recording storage means, such as a tape or disc recording carring images describing different items of merchandise available.

In other embodiments both audio and video messages are provided.

In some embodiments of the invention, the means for initiating delivery of said messages comprises a plurality of switches visually linked to product lines and arranged to cause corresponding recorded messages to be played when activated by a potential purchaser.

Another inventive feature which may be used in some embodiments of the invention is additionally the provision of audio synthesis means adapted to receive as an input data from the message storage means and to generate as an output an audible signal. In some embodiments the generated audible signal can be a synthesised voice which is responsive to data stored by the message storage means.

A further inventive feature which may be used in some embodiments of the invention is additionally the provision of video synthesis means adapted to receive as an input data from the message storage means and to generate as an output video signals and provision of video display means. In some embodiments the generated video output signals can be representative of a person and if desired this person can be made to appear to be speaking a message.

According to one beneficial application of the invention, the dispenser takes the form of a music jukebox in which the merchandise dispensed is musical selections and the stored messages are responsive to selections made and the operational status of the jukebox. In some embodiments the stored messages can include patter similar to that delivered by disc jockeys, exhortations to make further selections or insert coins, or messages selected by a customer.

BRIEF DESCRIPTION OF THE DRAWINGS

The foregoing and other objects, features, extensions, and advantages of the invention will be apparent from the following description of some exemplary embodiments of the invention, as illustrated in the accompanying drawings in which.

MODES FOR CARRYING OUT THE INVENTION

Figure 1:
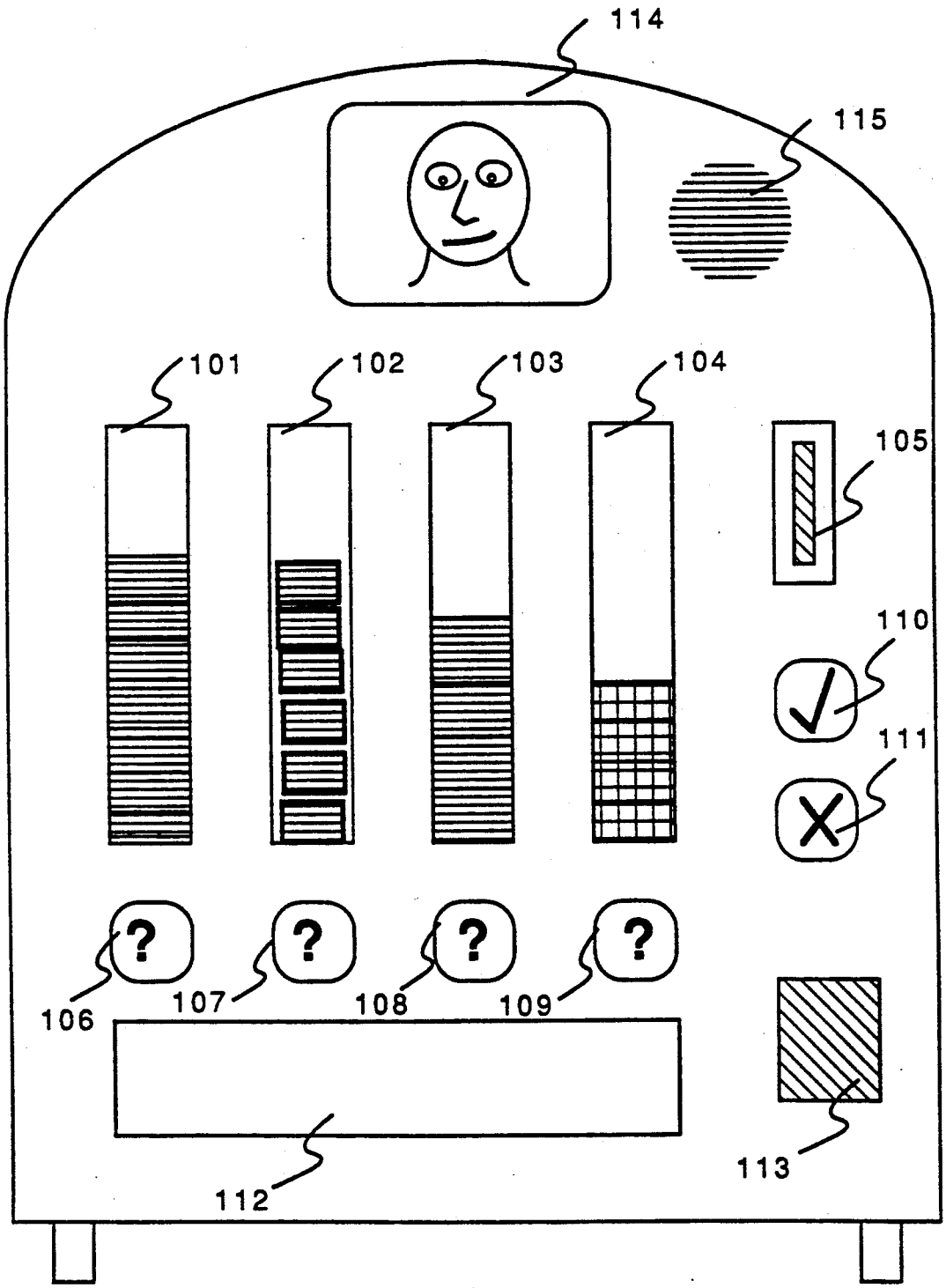
FIG. 1 shows the physical appearance of a vending machine according to the invention.

Referring to FIG. 1, a vending machine utilising the invention can be seen. The vending machine of this exemplary embodiment comprises four merchandise storage bins 101, 102, 103 and 104, each having a transparent window permitting viewing of the product lines stored therein. The vending machine is also equipped with the usual coin acceptor 105, coin return 113 and dispenser hopper 112. Video display 114 and loudspeaker 115 are provided to deliver stored messages relating to the available merchandise. When the machine is idle, a suitable message is periodically delivered exhorting passers-by to make a purchase. Selector switches 106, 107, 108 and 109 are used by a prospective purchaser to obtain information about any of the available product lines or to effect a purchase. After inserting the requisite coins, a customer can press one of the selector switches to receive a message describing the corresponding product. When the message is completed, description of another product can be obtained by pushing one of the other selector switches. To purchase an item, the customer pushes purchase switch 110, which causes the item corresponding to the last selector switch pressed to be dispensed from hopper 112. If the cancel switch 111 is pressed, the coins are returned and no purchase made.

Figure 2:
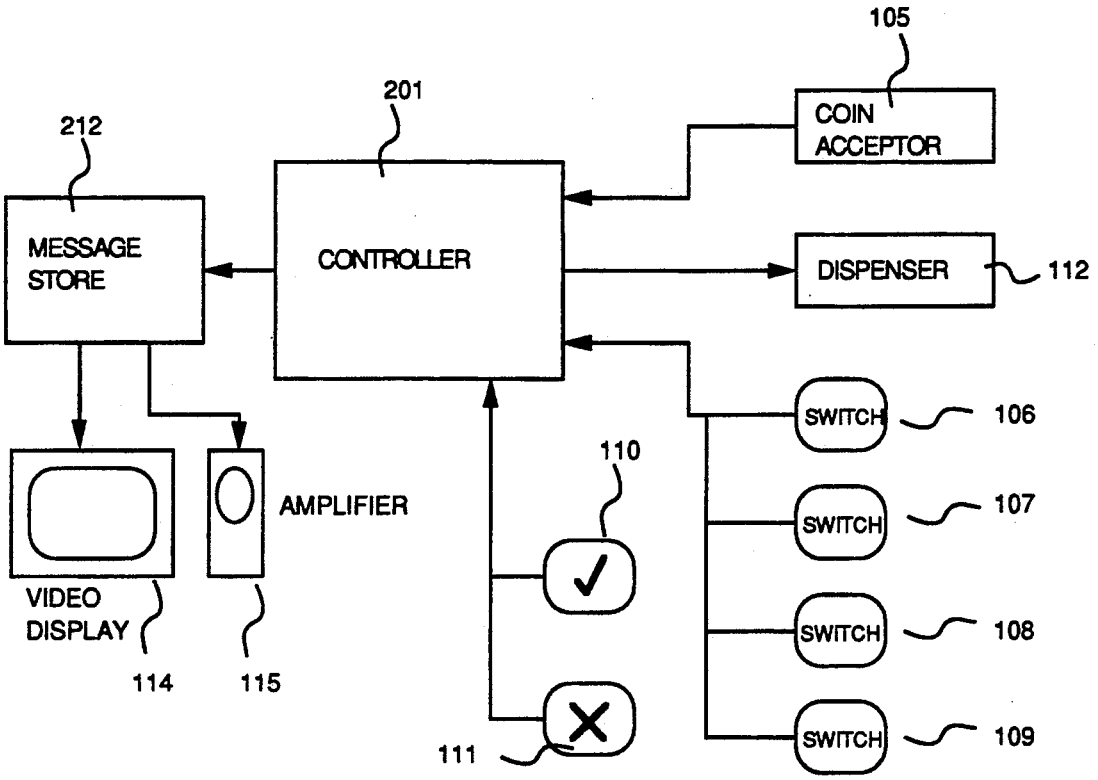
FIG. 2 is a block diagram of the vending machine of FIG. 1.

The operation of this embodiment of the invention will now be described in more detail with reference to the block diagram of FIG. 2. Referring now to FIG. 2, the inter-relationship between the components of the vending machine described in the foregoing paragraph can be seen. Controller 201, which for convenience can incorporate a suitably programmed microprocessor (not shown), receives input from selection switches 106, 107, 108 and 109 as well as purchase switch 110 and cancel switch 111. When any of the selection switches are pushed, after a coin has been sensed by coin acceptor 105, controller 201 causes a message relating to the corresponding product to be recalled from message store 212. Message store 212 can for convenience be an audio-video disk recording which can be randomly accessed to recall one of a number of messages stored thereon. This disk can comprise, for example, magnetic or optical recording medium. The messages can take the form of images accompanied by spoken words and music, in a manner similar to a brief television commercial. The image is displayed by video display 114 and the sound is reproduced by amplifier 115, through a loudspeaker. If purchase switch 110 is pushed during delivery of the message, the corresponding product is dispensed by dispenser 112 which receives a suitable control signal from controller 201. If another selection switch is subsequently pushed, a further message is accessed and delivered in like manner. If cancel switch 111 is pressed at any time prior to depression of purchase switch 110, controller 201 causes the coins tendered to be returned. While the machine is idle, that is, waiting for coins to be inserted, a timer within controller 201 periodically causes a message inviting purchase to be delivered. For good effect, this message can include instructions on operation of the machine.

Figure 3:
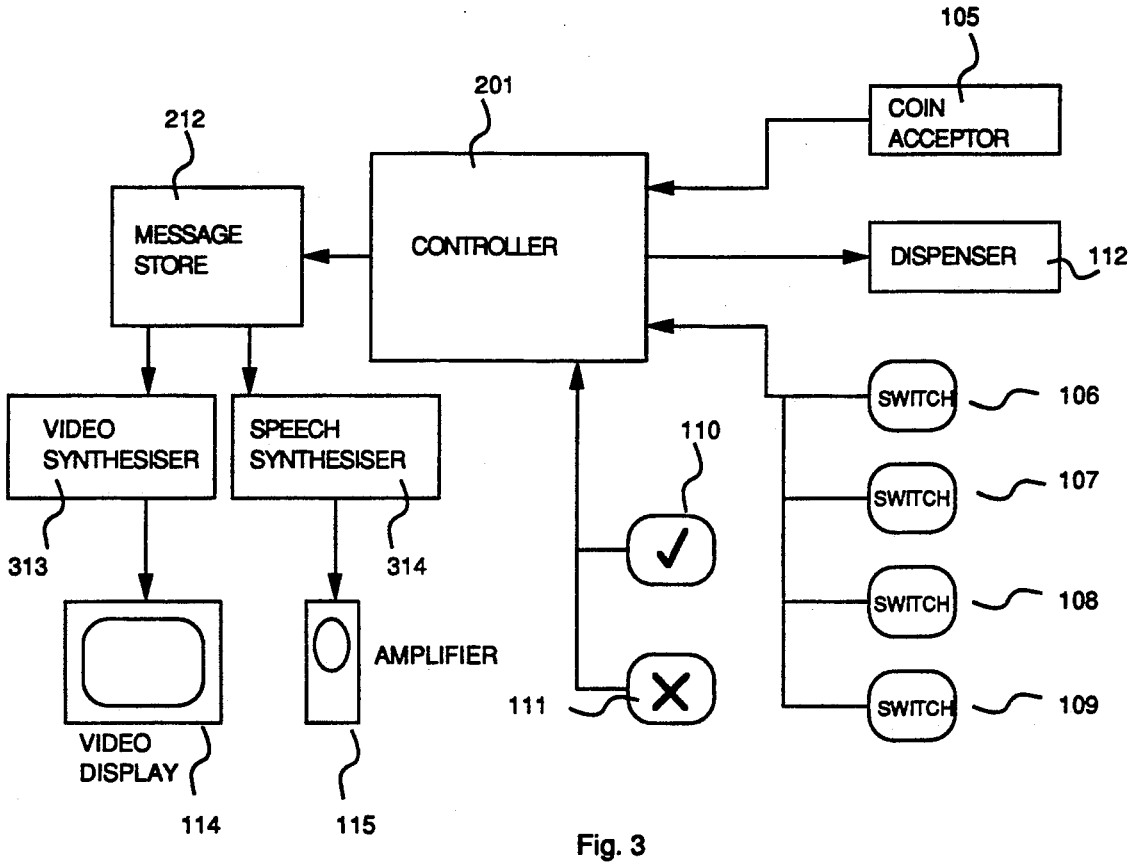
FIG. 3 is a block diagram of an alternative implementation of the vending machine of FIG. 1.

A further extension of the invention, shown in block diagram form in FIG. 3, is similar to the arrangement of FIG. 2 except that it also includes video synthesiser 313 and speech synthesiser 314. Operation of this embodiment is as described in the foregoing paragraph, except that instead of storing audio-video recordings, the message store 212 stores digital data suitable as control input for video synthesiser 313 and speech synthesiser 314. Video synthesiser 313 is adapted to generate at its output video signals suitable for display by video display 114. These signals, when displayed, create images which can be controlled by the data recalled from message store 212. Speech synthesiser 314 generates at its output signals which when reproduced by amplifier 115 and a loudspeaker are recognisable as words of human speech. In one advantageous arrangement, video synthesiser 313 is arranged to synthesise images of a person appearing to speak, and the stored messages are arranged to cause the person so synthesised to appear to speak the words being audibly reproduced. The advantage of this arrangement over that of FIG. 2 is that a much smaller amount of information is needed to convey a message of similar length, since only low-bandwidth control data specifying the movements of the synthesised image and controlling the speech synthesis is required, as opposed to the large amounts of high-bandwidth data required if the total image and sound is stored. Using this extension of the invention, message store 212 can take the form of a floppy disk, read-only memory or other low-cost storage means.

Figure 4:
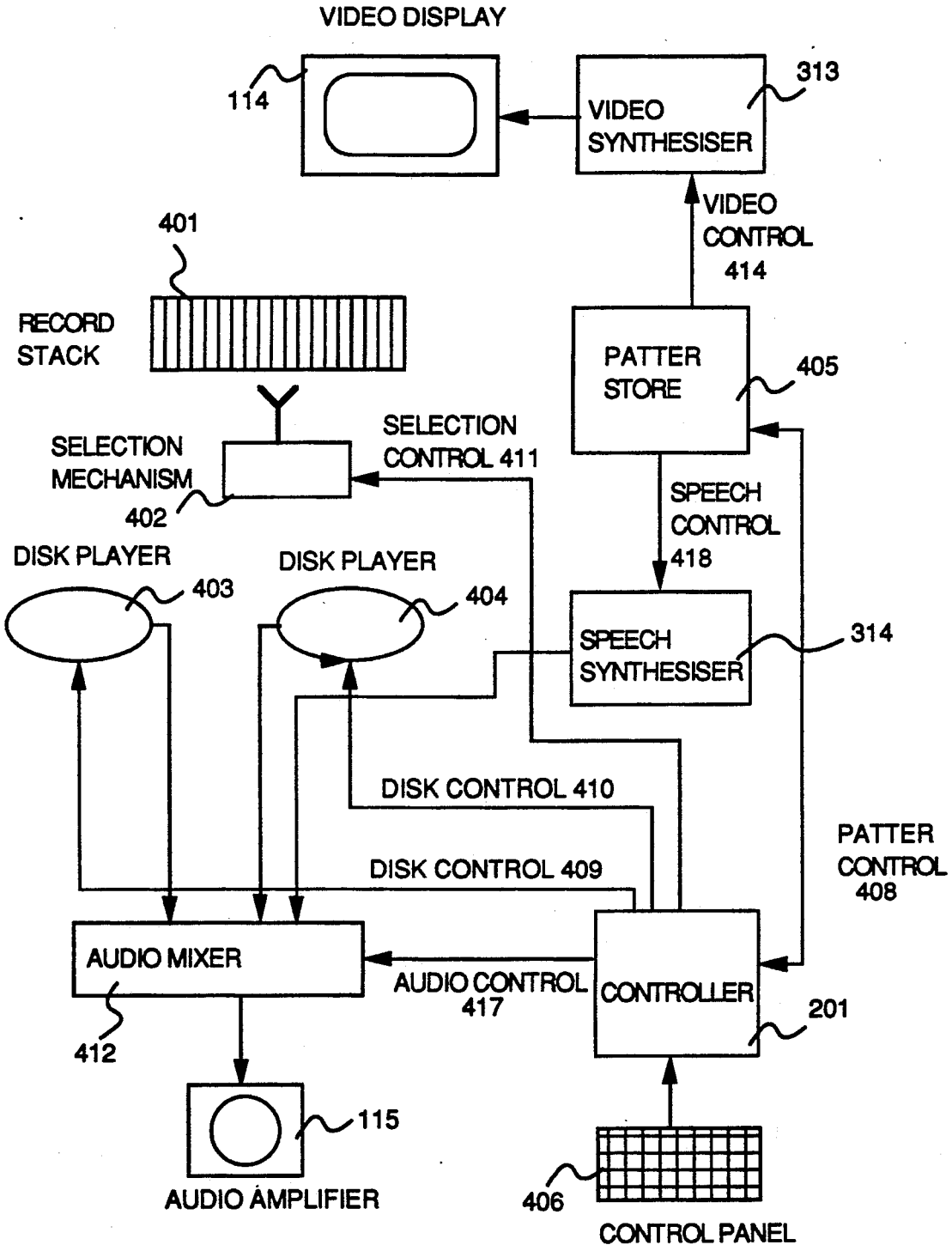
FIG. 4 is a block diagram of a jukebox according to the invention.

Referring now to FIG. 4, a block diagram of a jukebox according to this invention can be seen. In this embodiment of the invention, messages relating to musical selections available can be delivered before, during or after playing of music. The messages are designed to mimic the commentary commonly delivered by disk jockeys when records are being manually played, such commentary being known as "patter". The jukebox of this embodiment thereby achieves an effect similar to that of a disk jockey playing records, without the need for human intervention. As seen in FIG. 4, controller 201 receives, by means of control panel 406, user instructions indicating a series of records to be played. Control panel 406 can comprise a series of push-button switches, a touch-activated screen, or any other suitable interface device. According to the record first selected, controller 201 instructs selection mechanism 402 via selection control 411 to select the appropriate record from record stack 401, and place it on disk player 403 where the music on the record is reproduced and fed to audio mixer 412. Controller 201 then instructs patter store 405, via patter control signal 408, to access and retrieve data from the section of patter store 405 associated with the first selected record. Patter store 405 can be a magnetic disk, audio disk, optical disk, solid state memory or other data storage means. In this embodiment, patters comprise both video and audio components, with the purpose of providing an image on a screen which appears to be a carton-like disk-jockey speaking the words of the patter. Patters are stored in the form of data descriptive of the words spoken and data descriptive of movements of the image, rather than as audio and video recordings. This novel inventive technique is used to minimise the amount of storage required for patters, and to allow patters to be updated simply and inexpensively. In this embodiment, the patter store takes the form of a floppy-disk.

A plurality of different patters are stored on patter store 405, and each patter is logically linked to one or more of the available musical selections. For convenience, some records can be linked to a unique patter, describing that selection in particular, while other records can be linked to generic patters which, for example, describe a particular musical era or musical style. Patter store 405 can also contain data defining the duration of particular musical selections and patters. On receipt of the instruction from controller 201, the patter data relating to the imminent musical selection is recalled from patter store 405. The video component of the patter data is fed to video synthesiser 313 via video control 414 and the audio component of the patter data is fed to speech synthesiser 314 via speech control 418.

Video synthesiser 313 comprises animated-image generation means capable of producing a video signal representative of a disk-jockey, the animation of which is reponsive to video control 414. Video synthesiser 313 can be realised using any of the many techniques well known to those skilled in the art of computer graphics, for example the techniques commonly used in the realisation of arcade video games or other computer games. The image of the disk-jockey can be made to appear to speak by synchronising lip and other movements to the speech component of the patter. The speaking disk-jockey image so synthesised is fed to video display 114, which can be any suitable video display device.

Speech synthesiser 314 can be realised using any of the many well-known techniques available. One suitable arrangement comprises phoneme generation means which when fed with a suitable data stream from patter store 405 via speech control 418 causes phonemes to be generated sequentially so as to form spoken words, which are reproduced through audio mixer 412 and audio amplifier 115.

Controller 201 adjusts the mix between the sources of audio mixer 412 so that while the patter is being reproduced, the level of the record reproduction is reduced. This process can be simplified by equipping audio mixer 412 with automatic gain control circuitry which automatically reduces the gain of a given channel according to the audio signal present in another channel (a technique known to the audio engineering art as "ducking").

A short time before the conclusion of a record, as calculated by controller 201 from the duration data received from patter store 405, the next selected record is selected and played on disk player 404. At the same time, a concluding patter relating to the now-terminating record can be delivered, followed by the patter relating to the newly-selected record. The playing of the newly-selected record can commence a short time before the conclusion of the previous record, and a suitable cross-fade can be performed by audio mixer 412 under instruction from controller 201. The novel provision of two disk players instead of one as used in prior-art jukeboxes allows cross-fading between records, further improving the delivery of music by eliminating the undesirable interlude between records previously encountered due to the time taken to change records using only one player. While this is a desirable feature, it is not essential to the present invention, and jukeboxes using only a single playing mechanism benefit from provision of patter delivery according to the invention.

According to a further extension of the invention, an embodiment of the invention as shown in FIG. 4 is equipped with additional control means to provide delivery of messages directed to the public as requested by an operator of the jukebox. Such messages are intended to personalise musical selections, for example by inserting a person's name into a greeting. This is achieved in this embodiment by controller 201 which is adapted to input the name of a person to whom a greeting is to be delivered from a user by means of control panel 406. For this purpose control panel 406 of this embodiment comprises an alpha-numeric keyboard, as well as switches for selecting which greeting is required. An example of a greeting used in this embodiment is the words "This song is dedicated to Judy who is sixteen today", the name, in this case "Judy", and the age, "sixteen", being entered by the user and being substituted by controller 201 into the sentence stored in patter store 405.

While the invention has been described with reference to particular embodiments thereof, it will be understood by those skilled in the art that changes in the form and detail may be made without departing from the scope and spirit of the invention. For example, whereas the selection of merchandise and other functions have been described as being effected by the use of switches operated by a potential purchaser, ii is envisaged that a variety of alternative activating means can be used with good results. For example, it may in some cases be desirable to use a microphone and speech recognition means instead of the switches, rendering the invention apparently more interactive.

It is also envisaged that whereas certain embodiments of the invention are described herein as having speech synthesis capabilities, the invention can be adapted to provide musical accompaniment as well, using for example music synthesiser means. Furthermore, whereas an embodiment of a jukebox according to the invention is described herein as comprising speech synthesis and video synthesis means, controlled by data stored by the patter store, these are provided for convenience only and it is envisaged that the invention can be realised using a patter store on which patter is stored in the form of audio or video recordings suitable for replay directly without the intermediate video synthesis or speech synthesis means.

Whereas the invention is described in its application to dispensers which accept money for merchandise, it is equally applicable to dispensers which do not require payment to be received, or which receive payment by means other than coin receipt. The invention also finds application where no tangible merchandise is dispensed, as in the case of a jukebox as described herein, or in many other cases where the merchandise might be information, insurance cover or any other thing a customer may desire.

It will also be understood that the means for storing messages can take forms other than those described in relation to the embodiments herein. For example, solid-state memory can be used instead of magnetic or optical media. Furthermore, whereas in the embodiments described above the stored messages are changed by changing the storage medium for a new one, in other applications it may be desirable to change messages without changing media, and for this purpose read/-write storage means can be provided. For example, the invention can be equipped with erasable disk storage or read/write semiconductor memory for use as message store, and messages can be changed by loading suitable new information onto the store. If desired, this can be carried out from a remote location, for example by means of a radio link or telephone connection. In cases where such remote updating of messages is implemented, it is further possible to remotely interrogate the machine for information such as stock levels and coin holding.

It is further envisaged that control of delivery of messages during idle periods can be controlled by means other than the timer described in relation to the embodiments herein. For example, messages enticing purchases can be initiated on approach of a person to the machine. For this purpose a proximity detector, such as a passive infra-red detector, can be incorporated into the invention.

It will also be understood that whereas the messages delivered according to the embodiments described herein offer information about the dispensed merchandise, the messages need not be informative, the inventive concept being equally applicable in cases where messages of a purely entertaining or attention-seeking or other nature are to be delivered.

INDUSTRIAL APPLICABILITY

The invention can be used to provide vending machines, jukeboxes and like dispensers of merchandise which attract greater patronage than prior-art devices. The invention also benefits consumers of the dispensed merchandise by providing more informative and interesting product information than hitherto possible.

What is claimed is:

1. A dispenser comprising
   a. means for storing merchandise
   b. means for dispensing said merchandise
   c. means for initiating delivery of said merchandise
   d. message data storage means for storing messages, said messages relating to said stored merchandise
   e. means for retrieving said message data
   f. means for producing audible messages according to the content of said message data
   g. means for storing data describing graphical objects
   h. video synthesis means adapted to cause said graphical objects to be displayed on display means; and i. animation means adapted to cause said displayed objects to perform movements responsive to the content of said message data.

2. A dispenser according to claim 1 wherein the merchandise dispensed is music and the means for storing said merchandise is a recording medium, and the stored messages are descriptive of the music stored thereon.

3. A dispenser according to claim 2 further comprising control means adapted to cause said messages to be delivered immediately prior to the commencement of replay of a music recording.

4. A dispenser according to claim 2 wherein the means for dispensing merchandise comprises two recording-player mechanisms arranged to allow delivery of consecutive musical selections without intervening delay.

5. A dispenser according to claim 2 and further comprising control means to cause said messages to be modified according to information input by a user of the dispenser.

6. A dispenser according to any of claims 1 to 5 wherein the message data storage means for storing messages stores data representative of individual speech phones and means for producing audible messages comprises speech synthesis means.

7. A dispenser according to any of claims 1 to 5 in which said video synthesis means is adapted to produce an image representative of a person apparently speaking the words synthesised by said speech synthesis means.

8. A dispenser according to any of claims 1 to 5 and further comprising means for periodically initiating delivery of said messages when said dispenser is idle.

9. A dispenser according to any of claims 1 to 5 and further comprising means for initiating delivery of said messages when a person approaches said dispenser.

* * * * *